US006443727B1

(12) United States Patent
Huang

(10) Patent No.: US 6,443,727 B1
(45) Date of Patent: Sep. 3, 2002

(54) LIGHTER WITH A LOCK-OFF MECHANISM

(76) Inventor: Xinhua Huang, Kaifa Road, Cixi Economic Development Zone, Cixi, Ningbo City, Zhejiang 315300 (CN)

( * ) Notice: Subject to any disclaimer, the term of this patent is extended or adjusted under 35 U.S.C. 154(b) by 0 days.

(21) Appl. No.: 09/861,946

(22) Filed: May 21, 2001

(30) Foreign Application Priority Data

Nov. 17, 2000 (CN) ..... 00260367 U

(51) Int. Cl.[7] ..... F23Q 7/24; F23Q 2/16; F23Q 2/40; F23Q 2/28; F23D 11/36

(52) U.S. Cl. ..... 431/132; 431/153; 431/255

(58) Field of Search ..... 431/153, 255, 431/277, 132; 292/142

(56) References Cited

U.S. PATENT DOCUMENTS

| | | | | |
|---|---|---|---|---|
| 2,532,630 A | * | 12/1950 | Lickteig | |
| 2,629,998 A | * | 3/1953 | Bolle | |
| 2,934,370 A | * | 4/1960 | Love et al. | |
| 3,442,598 A | * | 5/1969 | Halm | |
| 4,419,073 A | | 12/1983 | Racek | 431/344 |
| 6,135,761 A | * | 10/2000 | Chen | |

FOREIGN PATENT DOCUMENTS

| | | | | |
|---|---|---|---|---|
| DE | 699213 | * | 10/1940 | 431/134 |
| EP | 0372989 | | 6/1990 | |
| FR | 975611 | * | 3/1951 | 431/151 |
| JP | 7-19470 | * | 1/1995 | 431/153 |

* cited by examiner

*Primary Examiner*—Carl D. Price
(74) *Attorney, Agent, or Firm*—Ostrolenk, Faber, Gerb & Soffen, LLP

(57) ABSTRACT

A safety lighter is locked in a non-operable condition with a safety latch operable with a rotatable gear device. The rotatable gear is located in a top surface of the lighter actuator, and is coupled to a rack that moves linearly when the gear is rotated. The rack is extended into or withdrawn from the lighter housing to prevent or permit actuation of the lighter mechanism, respectfully. A lower portion of the rack has a sloped profile to permit the rack to be pushed upward by the lighter housing when the actuation device is returned to a normal, locked position. In the normal, locked position, the rack is driven into the lighter housing by a spring located in the actuator. The actuator mechanism is unlocked by rotating the gear in a direction opposite to that of the rotational direction for operating the actuator. The location of the gear on the top surface of the actuator permits the actuator to be unlocked and operated by an adult in a simple manner, while making the same task difficult for a child.

11 Claims, 2 Drawing Sheets

LIGHTER WITH A LOCK-OFF MECHANISM

FIELD OF THE INVENTION

The present invention relates to a lighter with a lock-off mechanism.

DESCRIPTION OF THE PRIOR ART

A lighter commonly used at present is an electric lighter-igniter using combustible gas, such as butane gas and natural gas, as a fuel. The lighter can generate a flame usually through a person pressing the operative actuator directly with their fingers and permitting the piezoelectric block in a piezoelectric device to spark so as to ignite the combustible gas. Without a lock-off mechanism (or a safety device) in the lighter, the operation of the actuator is not restricted. An unintentional operation of the actuator, such as an erroneous operation, an operation by an infant, or some unintentional collision by a hard thing acting on the actuator, can easily ignite the lighter containing the combustible gas. Such unintentional operation can hurt the infant or become a public safety hazard. In addition, when an external force unintentionally acts on the actuator, the fuel outlet valve opens, and the combustible gas leaks, resulting in a potential risk of combustion without notice. Therefore, some countries and territories have prohibited or will prohibit the production and/sale of lighters that lack a lock-off mechanism.

SUMMARY OF THE INVENTION

An object of the present invention is to overcome the above-mentioned technical defects of the prior art, and to provide a lighter having a lock-off mechanism that can prevent the lighter from being actuated in a direct manner, and avoid the above-mentioned potential risk. The lighter of the present invention can provide not only a greater ignition efficiency, but also greater safety.

In order to achieve the above object, according to the present invention, there is provided a lighter which comprises a tank for housing the fuel, a piezoelectric device in a housing holding the tank, and outlet device, and a windshield above the tank. The piezoelectric device comprises a piezoelectric block and an actuator, and a force applied on the piezoelectric block by the actuator causes the piezoelectric block to generate a strong instantaneous current and create electric sparks. The outlet device comprises an outlet valve, a regulator ring and a lever. The lever opens the outlet valve when driven by the actuator and the regulator ring is adapted to adjust the air output and size of the resulting flame. The actuator is provided with a lock-off mechanism comprising a gear as a rotatable control member, a rack as a linearly removable locking member, and a return spring. The gear engages with the rack to move the rack in opposition to and cooperates together with it, the return spring located between the actuator and the rack. The lower end of the rack is maintained in the lighter housing in a no-operation condition to lock the lighter. In this case, the actuator cannot move with directly applied pressure. The actuator can be moved only after the gear is rotated to cause the rack to disengage from the lighter housing to release the actuator lock.

According to one aspect of the lighter with a lock-off mechanism of the present invention, the lower end of the rack is of an arc shape, which can smoothly transit the lighter housing edges, so that the actuator can be moved and returned smoothly.

According to the other aspect of the present invention, the gear is pivotally arranged in a chamber in the actuator. The pivotal arrangement can be achieved by a rotation shaft, with two fitted projections provided on opposed sides of the gear center and placing the rotation shaft into recesses in the actuator. Other equivalent arrangements can be used to make the rotation of the gear flexible.

According to an other aspect of the present invention, the return spring is accommodated in a chamber formed by the actuator and the rack. The return spring can be a compression spring vertically mounted in the chamber or a torsion spring sleeved on the rotation shaft of the gear.

According to another aspect of the present invention, a lower cover is provided at the bottom of the tank to ensure that the tank is reliably sealed.

According to the invention, the actuator is provided at one side with the cooperating lock-off mechanism. If the lock-off mechanism is not operated, the actuator will not move, and thereby improve the safety of the lighter and prevent erroneous operation.

The present invention will be described in detail by way of example and with reference to the accompanying drawings.

DESCRIPTION OF PREFERRED EMBODIMENT

Figure 1:
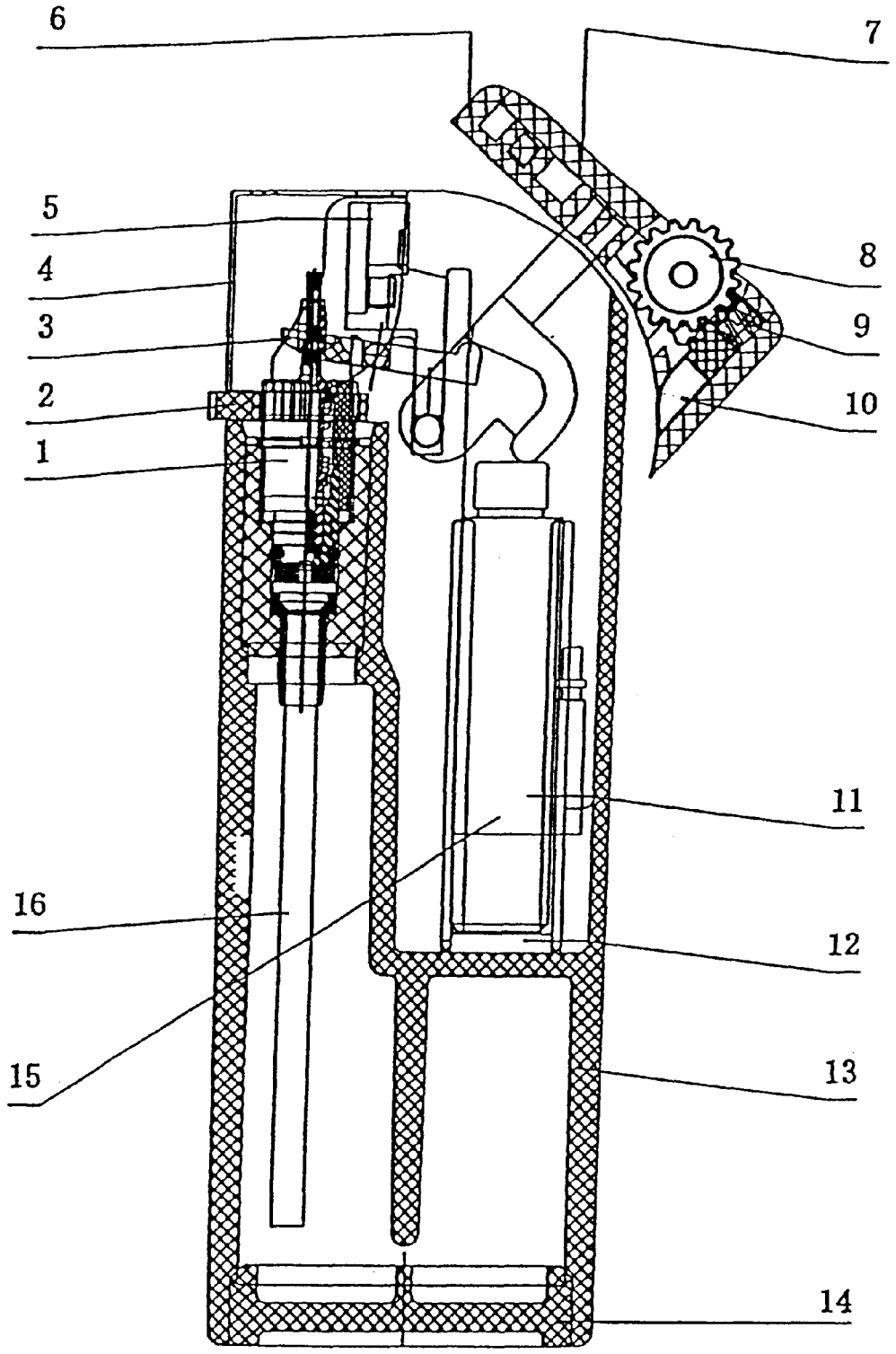
FIG. 1 is a schematic view showing the general configuration of the lighter according to the present invention.

As shown in FIG. 1, the lighter of the present invention comprises a housing with a tank 13, a piezoelectric device 15 in the housing, an outlet device 16 and a windshield 4 above the outlet device. An actuator 6 is located over the windshield, and an inner shield 5 is located in the windshield 4. A top cover 7 on the actuator, and a lower cover 14 at the bottom of the tank 13 are also shown. The piezoelectric device 15 comprises a piezoelectric block 11, an actuator 6 and a rubber cushion 12. The outlet device 16 comprises an outlet valve 1, a regulator ring 2 and a lever 3, which are all assembled together in a conventional manner. The actuator 6 is provided with a lock-off mechanism formed by a gear 8, a rack 10 and a return spring 9. The gear 8 engages with the rack 10 and co-operates together with it. The rack 10 can move up or down under the action of the gear 8 and the return spring 9 so as to disengage from or be inserted into the housing in order to release or achieve a locked state. The windshield 14 is adapted to shield the flame from the wind, the inner shield 5 is adapted to isolate the flame and the cushion 12 can absorb a shock from actuation of the piezoelectric device 15. The tank 13 houses the liquefied gas, which becomes gaseous when released through outlet valve 1.

Figure 2:
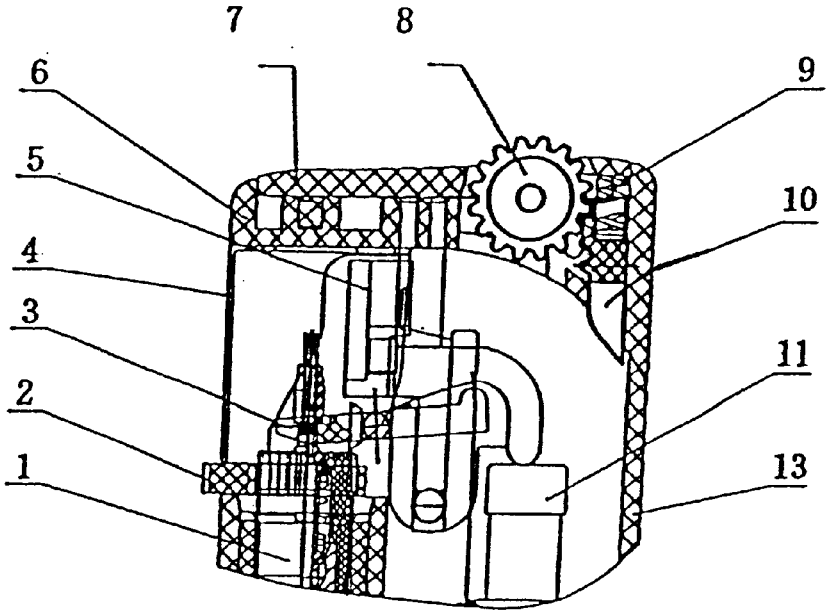
FIG. 2 is a schematic view showing the lighter in its locking position according to the invention.

As shown in FIG. 2, in the lock position, the lower end of the rack 10 is inserted into the housing under the action of the return spring 9. At this time, the actuator cannot be moved with application of direct force. The lighter remains in a locked state even if there is a force applied on the gear 8 in the clockwise direction, since the lower end of the rack 10 abuts against the inner wall of the housing. Under these circumstances, the gear 8 cannot be rotated, so that the lighter remains locked off.

Figure 3:
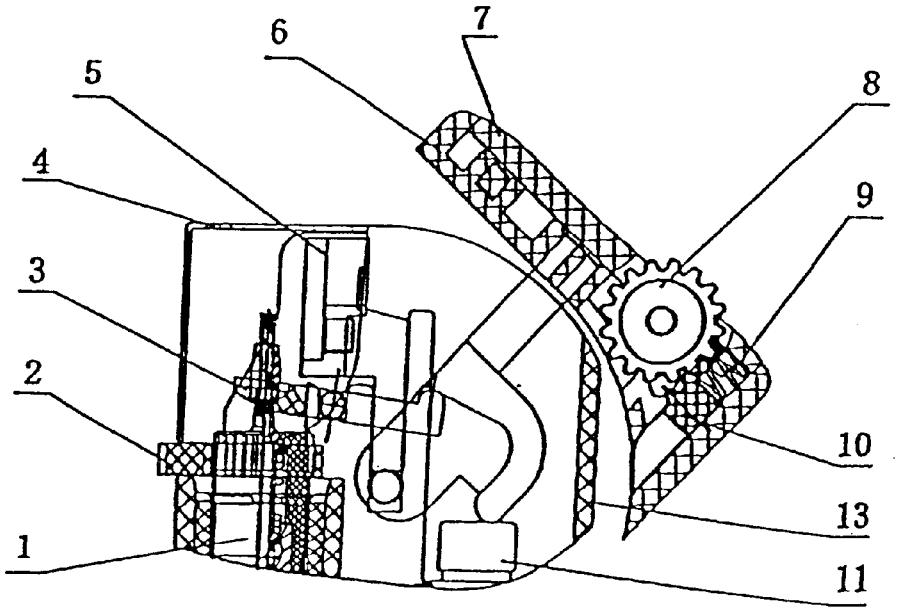
FIG. 3 is a schematic view showing the lighter in its operating position according to the invention.

As shown in FIG. 3, when igniting the lighter, the gear 8 is driven in the counter clockwise direction. The rack 10 engaged with the gear 8 moves up and disengages from the housing, to unlock the lighter. The actuator 6 is now free to be moved or turned by application of a clockwise rotation. Thus, turning the actuator 6 will drive the lever 3 to open the outlet valve 1, and the piezoelectric block 11 sparks simultaneously and ignites the combustible gas. The flame will not be extinguished until the actuator 6 is released. Adjusting the regulator ring 2 can change the extension of the flame. If the user wants to extinguish the flame, the actuator 6 is released, which will permit the actuator 6 to be restored automatically to a home position. The rack 10 then returns to the locking position under the force of the return spring 9, so that the lighter is restored to the locked condition. Subsequently, the lever 3 is restored to close the outlet valve 1, and the flow passage of the combustible gas is cut off, so that the flame is distinguished.

The scope of the present invention includes, but not exclusively, the example described above, various equivalent modifications and variations of the lock-off mechanism, which utilizes engagement between a rotatable control member and a linearly movable locking member so as to make both members cooperate together. For example, the control member may be a gear, a crank, a ratchet wheel, a cam or the like, the locking member cooperated with the control member may be a rack or a straight strap, etc., and the return mechanism making the locking member return has a resilient return function that includes a spring, a steel strap, a spring leaf or the like.

What is claimed is:

1. A safety mechanism for a lighter, comprising:

an actuator having a top surface and an opening therein;

a rotatable gear member in said opening;

a rack engaged with and operable by said gear member;

a resilient member urging said rack downward to extend into a body portion of said lighter thereby preventing operation of said actuator; and said gear member operable to move said rack in a direction against said urging provided by resilient member to thereby retract said rack from extending into said body portion and permitting said actuator to operate.

2. A safety mechanism according to claim 1, wherein said actuator pivots about a point when actuated.

3. A safety mechanism according to claim 2, wherein said gear member is rotationally operable in a direction relatively opposite to an actuation pivot direction of said actuator.

4. A lighter with a safety mechanism, comprising:

a housing with a fuel chamber;

an outlet valve connected to said fuel chamber;

a lever coupled to said outlet valve and operable to open and close said outlet valve;

a piezoelectric block operable to generate electric charge;

an actuator operable on said piezoelectric block and said lever to open said outlet valve while generating an electric charge from said piezoelectric block with sufficient voltage to cause a spark and ignite a vaporized fuel releasable from said fuel chamber through said outlet valve, said actuator having a top surface;

a rotatable gear member in an opening in said top surface;

a rack engaged with and operable by said gear member;

a resilient member urging said rack downward to extend into said housing thereby preventing operation of said actuator; and said gear member operable to move said rack in a direction opposite of said urging provided by said resilient member thereby permitting said actuator to operate.

5. A lighter according to claim 1, wherein an end of said rack extending into said housing has a sloped profile that can cooperate with an edge of said housing to urge said rack upward when said actuator is returned to a home position.

6. A lighter according to claim 1, wherein said gear member rotates about a fixed point in said actuator.

7. A lighter according to claim 6, wherein said actuator pivots about a point located in said housing when actuated.

8. A lighter according to claim 7, wherein said actuator and said gear member actuate in relatively opposite rotational directions.

9. A lighter according to claim 1, wherein said resilient member is a spring.

10. A lighter according to claim 9, wherein said spring is located in a chamber in said actuator.

11. A lighter according to claim 1, further comprising a cover on a bottom portion of said housing.

* * * * *